United States Patent [19]

Bader et al.

[11] Patent Number: 4,991,866

[45] Date of Patent: Feb. 12, 1991

[54] CLAMP ASSEMBLY FOR SKI BINDING

[75] Inventors: Manfred Bader, Peissenberg; Edwin Lehner, Garmisch-Partenkirchen, both of Fed. Rep. of Germany

[73] Assignee: Marker Deutschland GmbH, Eschenlohe, Fed. Rep. of Germany

[21] Appl. No.: 388,986

[22] Filed: Aug. 2, 1989

[30] Foreign Application Priority Data

Aug. 2, 1988 [DE] Fed. Rep. of Germany ..... 3826270

[51] Int. Cl.[5] ..... A63C 9/00

[52] U.S. Cl. ..... 280/631; 280/633

[58] Field of Search ..... 280/607, 617, 618, 633, 280/631, 623; 403/119, 163

[56] References Cited

U.S. PATENT DOCUMENTS

| | | | |
|---|---|---|---|
| 3,963,253 | 6/1976 | Rieger | 280/607 X |
| 4,139,214 | 2/1979 | Meyer | 280/607 |
| 4,141,570 | 2/1979 | Sudmeier | 280/618 X |
| 4,546,521 | 10/1985 | Ribarits | 280/633 X |

FOREIGN PATENT DOCUMENTS

| | | | |
|---|---|---|---|
| 1810212 | 6/1970 | Fed. Rep. of Germany . | |
| 2135450 | 4/1972 | Fed. Rep. of Germany . | |
| 2306852 | 8/1974 | Fed. Rep. of Germany . | |
| 2554385 | 6/1977 | Fed. Rep. of Germany . | |
| 371730 | 12/1982 | Fed. Rep. of Germany . | |
| 14219 | 4/1897 | Switzerland | 280/618 |
| 166253 | 12/1933 | Switzerland | 280/618 |

*Primary Examiner*—Charles A. Marmor
*Assistant Examiner*—Michael Mar
*Attorney, Agent, or Firm*—D. Peter Hochberg; Mark Kusner; Louis J. Weisz

[57] ABSTRACT

A clamp for mounting a base plate of a ski binding to a ski, the base plate being operative to move longitudinally along the axis of the ski and having outwardly extending side sections. The clamp includes: a pair of opposed side portions having inward facing guide members operative to engage the side sections of the base plate and to guide the base plate along the longitudinal axis of the ski. Each side portion includes a cylindrical recess, wherein the recesses extend along a common axis which is transverse to the axis of the ski. A pair of cylindrical members dimensioned to be received within the recesses is provided. The cylindrical members are secured to the ski, wherein the side portions are capable of limited pivotable on the cylindrical members about the transverse axis.

4 Claims, 1 Drawing Sheet

CLAMP ASSEMBLY FOR SKI BINDING

FIELD OF THE INVENTION

The present invention relates generally to ski bindings, and more particularly to a component for securing a base plate of such a binding to a ski.

BACKGROUND OF THE INVENTION

The present invention relates generally to a clamp for securing a base plate to a ski. Such clamps are typically provided to clamp one end of a base plate to the ski yet permit limited longitudinal movement of the base plate through the clamp. Such clamps typically include side portions having grooves adapted to receive and guide the laterally extending portions of the base plate. Normally, a connecting member connects the side portions of the clamp and is disposed between the base plate and the upper surface of the ski. Because the base plate is not only supported by the connecting member, but is also confined by the side portions which guide the base plate, the base plate may "bind" or become "locked" in the clamp in the event of a deflection of a ski. To avoid this problem, it is normally known to dimension the guides through the side portion to provide a space or "vertical play" between the base plate and the guide surfaces of the side portions. It has also been known to provide an elastic plastic insert to bridge the vertical "play" defined between the clamp and the base plate.

Such assemblies which permitted displacement between the base plate and the clamp are undesirable, particularly if the base plate is long. In this respect, the play in the clamp creates an additional bending stress in the base plate. It is preferable to provide a clamp which secures the base plate to the ski without vertical play between the two members to avoid a binding or locking of the base plate in the event of deflection of the ski, but which would at the same time permit movement of the base plate relative to the surface of the ski in the event of such deflection.

SUMMARY OF THE INVENTION

In accordance with the preferred embodiment of the present invention, there is provided a clamp for mounting a base plate of a ski binding to a ski, the base plate being operative to move longitudinally along the axis of the ski and including outwardly extending side sections. The clamp is comprised of the pair of opposed side portions having inwardly facing guide means operative to engage the side sections of the base plate and to guide the base plate along the longitudinal axis of the ski. Each side portion includes a cylindrical recess, the recesses in the respective side portions extending along a common axis which is transverse to the axis of the ski. A pair of cylindrical members is provided to be received within the recesses of the side portions. Means for securing the cylindrical members to the ski are provided wherein the side portions of the clamp are capable of limited pivotal movement on the cylindrical members about the transverse axis.

In this respect, the clamp as described above is mounted on the ski and permits limited pivotal movement of the base plate about a transverse axis horizontal to the upper surface of the ski. In the event of a deflection of the ski resulting in a change of the angle between the base plate and the top surface of the ski, the clamp will automatically adapt itself to the inclination of the base plate relative to the top surface of the ski. This will avoid a binding or locking of the base plate in the clamp (i.e. still permit guided movement of the base plate within the clamp) and the elasticity of the ski will not be adversely affected. Moreover, the deflection of the ski will not adversely influence a lateral safety release.

THE DRAWINGS

The invention may take physical form in certain parts and arrangement of parts, a preferred embodiment of which will be described in detail in the specification and illustrated in the accompanying drawings wherein.

DETAILED DESCRIPTION OF PREFERRED EMBODIMENT

Figure 1:
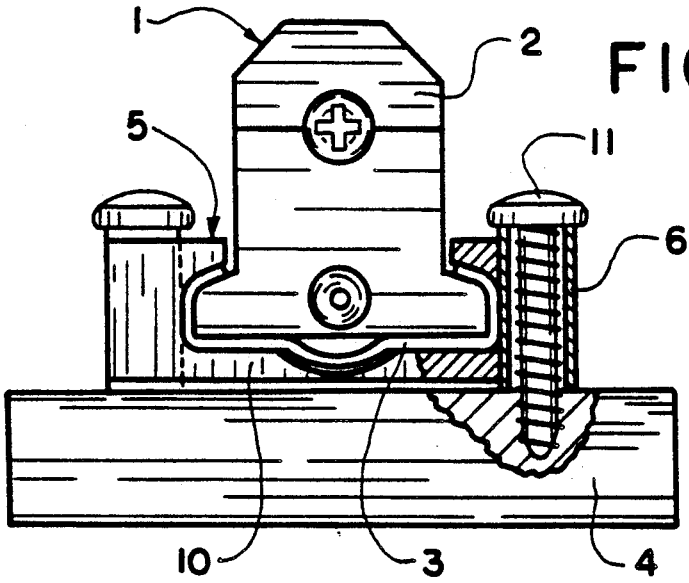
FIG. 1 is an end elevational view of a ski binding component mounted on a ski illustrating a preferred embodiment of the present invention.

Referring now to the drawings wherein the showing is for the purpose of illustrating a preferred embodiment of the invention only and not for the purpose of limiting same, FIG. 1 shows a heel holding device having a housing portion comprised of a carriage 2 mounted on a base plate 3 for displacement along the longitudinal axis of a ski 4. As is conventionally known, the displacement is affected from a forward position against the force of a pressure applying spring (not shown). The forward end portion may be varied so that the pressure applied can be altered and the ski binding can be adapted to secure boot soles having various lengths. A sole holder (not shown) for retaining the boot sole is normally provided on carriage 2. Base plate 3 is secured to ski 4 at one end (not shown) by screw means at a location adjacent to the ski boot so as to provide a fixed mounting on the ski at one end of the base plate 3. A clamp 5, is provided for holding base plate 3 on the ski at the end of the base plate which is remote from the ski boot. Clamp 5 provides a slide mounting which enables movement of base plate 3 therethrough.

Figure 2:
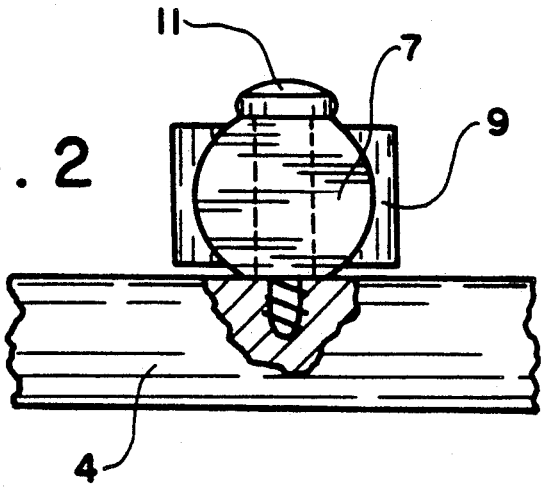
FIG. 2 is a side elevational view of the component shown in FIG. 1.
Figure 3:
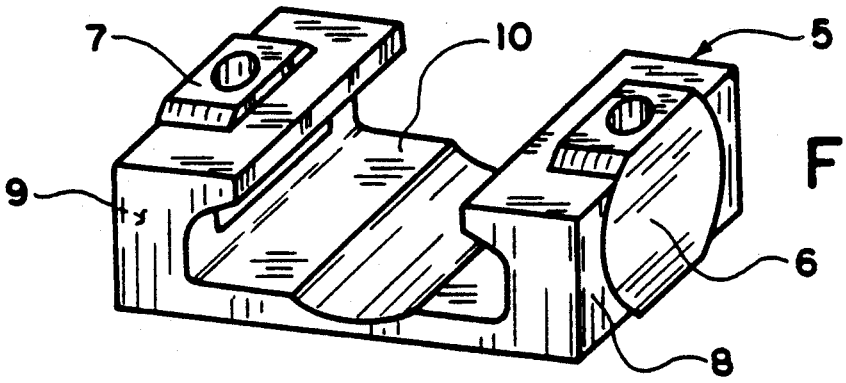
FIG. 3 is a perspective view showing a component shown in FIG. 1.

In accordance with the present invention, clamp 5 is mounted on ski 4 to provide limited pivotal movement about a transverse horizontal axis. As best seen in FIGS. 2 and 3, clamp 5 is comprised of two cylindrical members 6, 7 which are pivotally mounted in recesses formed in side portions 8, 9 of clamp 5. As shown in the drawings, disks 6, 7 project beyond the upper and lower surface of side portions 8, 9 of clamp 5. A cross piece 10 connects side portion 8 with side portion 9. Clamp 5 is secured to ski 4 in the conventional manner by screws 11 extending through holes in disks 6, 7 transverse to ski 4. Those portions of cylindrical members 6 and 7 which extend beyond the upper and lower surfaces of side portions 8 and 9 include flattened areas. The top flattened area provides a surface for engagement by the head of screw 11, and the bottom flattened area provides a surface for mating engagement to ski 4.

The present invention thus provides a clamp for securing a base plate to a ski, which clamp allows limited pivotal movement of the base plate relative to the ski and longitudinal movement of the base plate along the axis of the ski. The ability of the base plate to pivot reduces the likelihood of the base plate binding within the clamp.

The invention has been described with respect to a preferred embodiment, modifications of which will occur to others upon their reading and understanding of the specification. For example, those portions of cylindrical members 6 and 7 which project beyond the under surface of cross member 10 of clamp 5 may be interconnected by a cross bar (not shown). It is intended that all such modifications and alterations be included in so far as they come within the scope of the patent as claimed with equivalents thereof.

We claim:

1. A clamp for mounting a base plate of a ski binding to a ski, said base plate operative to move longitudinally along the axis of said ski and including outwardly extending side sections, said clamp comprising:

a pair of opposed side portions having inwardly facing guide means operative to engage said side sections of said base plate and to guide said base plate along said longitudinal axis of said ski, each side portion including a cylindrical recess, said recesses extending along a common axis which is transverse to the axis of said ski;

a pair of cylindrical members dimensioned to be received within said recesses said side portions including an upper surface and a lower surface and said cylindrical recesses communicating with said upper and lower surfaces through openings formed therein; and means for securing the lower portion of said cylindrical members into fixed engagement with said ski, wherein said side portions are capable of limited pivotal movement on said cylindrical members about said transverse axis.

2. A clamp according to claim 1 wherein a portion of said cylindrical members extend beyond said upper and lower surfaces.

3. A clamp according to claim 2 wherein said attached cylindrical member includes a flat portion engaging said ski.

4. A clamp according to claim 1, wherein said side portions are connected by a transverse portion.

* * * * *